US007076825B2

(12) United States Patent
Fellhauer

(10) Patent No.: US 7,076,825 B2
(45) Date of Patent: Jul. 18, 2006

(54) FLOOR MACHINE WITH HANDLE ATTACHMENT

(75) Inventor: Jeffery R. Fellhauer, Toledo, OH (US)

(73) Assignee: NSS Enterprises, Inc., Toledo, OH (US)

( * ) Notice: Subject to any disclaimer, the term of this patent is extended or adjusted under 35 U.S.C. 154(b) by 568 days.

(21) Appl. No.: 10/237,314

(22) Filed: Sep. 9, 2002

(65) Prior Publication Data

US 2004/0045108 A1 Mar. 11, 2004

(51) Int. Cl.
*A47L 11/00* (2006.01)
*A47L 11/162* (2006.01)

(52) U.S. Cl. ..... 15/49.1; 15/98

(58) Field of Classification Search ..... 15/49.1, 15/98, 50.1; 451/353
See application file for complete search history.

(56) References Cited

U.S. PATENT DOCUMENTS 1,820,482 A * 8/1931 Orth ..... 15/49.1
3,100,903 A * 8/1963 Doyle, Sr. ..... 15/49.1
3,428,984 A * 2/1969 Collier ..... 15/49.1
4,186,030 A 1/1980 Armstrong
5,674,120 A * 10/1997 Legatt et al. ..... 451/350

OTHER PUBLICATIONS

Hawk Owner's Manual, Floor Machine Assemblies.
Floor Maintenance Equipment, General Floorcraft, Inc..
Standard Speed 17"/20" Floor Machine Manual, pp. 1-12, Jul. 1996.
Mustang Floor Machine Manual, pp. 1-12, The National Super Service Company, Sep. 1996.
Mercury Floor Machines, All Metal Heavy Industrial Floor Machines, Commercial Janitorial Equipment.
Search Report; First Office Action dated Sep. 17, 2004, Chinese Patent Appln. No. 03156739.8.

* cited by examiner

*Primary Examiner*—Gladys J. P. Corcoran
*Assistant Examiner*—Shay L. Balsis
(74) *Attorney, Agent, or Firm*—Emch, Schaffer, Schaub & Porcello Co., L.P.A.

(57) ABSTRACT

A floor machine for cleaning floors with a rotary brush or buffer includes (1) a base assembly having a motor and skirt with no frame and (2) a handle and frame assembly. The frame/handle assembly can readily be attached to the base assembly by a simple engagement of the frame to a support mounted on the housing of the motor. This permits (1) the handle and frame assembly to be packaged in a shipping carton which need only be tall enough to accommodate the wheel diameter of the handle/frame assembly and (2) the base assembly of motor and skirt to be packaged in a second carton having a size which need only accommodate such base/motor and skirt assembly with no significant wasted space.

5 Claims, 6 Drawing Sheets

FLOOR MACHINE WITH HANDLE ATTACHMENT

The present patent application is directed to a floor machine of a type used for cleaning floors and carpets with a rotatable brush, buffer or similar rotating member which contacts the floor or carpet in combination with a simple handle attachment.

BACKGROUND OF THE INVENTION

Prior art floor machines typically have a motor mounted on a base consisting of a frame and skirt assembly with a handle attached to the base. The prior art designs with the handle attached to the base result in inefficiencies from one of two standpoints. Under a number of prior art floor machine designs, the attachment of the handle to the frame is such that it is desirable to ship such floor machines with the handle attached and standing in an upright position extending upwardly from the base frame/skirt assembly with the motor mounted thereon. As a result of the handle extending to a height of two or more feet above the top of the motor, a shipping carton for packing and shipping this type of prior art machine will contain a significant amount of wasted space thereby increasing the cost of shipping over that required if there were no significant wasted space.

Although some prior art machines have attempted to overcome the wasted space problem by providing a handle which may be folded from (1) a position extending generally upwardly from the base and generally perpendicular to the surface to be cleaned to (2) a position substantially parallel to the surface to be cleaned, such foldable handles are complex and expensive to manufacture.

When the handle is assembled to the base and does not have the capability of being folded to a position parallel to the floor, the machine, when packaged in a shipping container having rectangular sides will result in significant wasted space and an overall package size that restricts shipping options. Attempts to ship the handle and base assembly separately to be assembled upon receipt have been, for the most part, commercially unsuccessful due to numerous linkage points between the handle and the base. In the prior art, it was found that such linkages are necessary to enable handle adjustment and ensure a robust interface between the handle and the base. However, the complexity of such assembly operation was not well received by customers.

SUMMARY OF THE INVENTION

The present invention is directed to a floor machine in which the frame is part of the handle assembly. The base assembly is the motor and skirt with no frame. The frame/handle assembly can readily be attached to the base assembly by a simple engagement of the frame to a support mounted on the housing of the motor. This permits (1) the handle and frame assembly to be packaged in a shipping carton which need only be tall enough to accommodate the wheel diameter of the handle/frame assembly and (2) the base assembly of motor and skirt to be shipped in a second carton having a size which need only accommodate such base/motor and skirt assembly with no significant wasted space. Engagement of the frame/handle assembly to the base assembly can be easily effected by simple engagement of as few as two or three bolts or nuts and bolts.

DETAILED DESCRIPTION OF THE INVENTION

Figure 1:
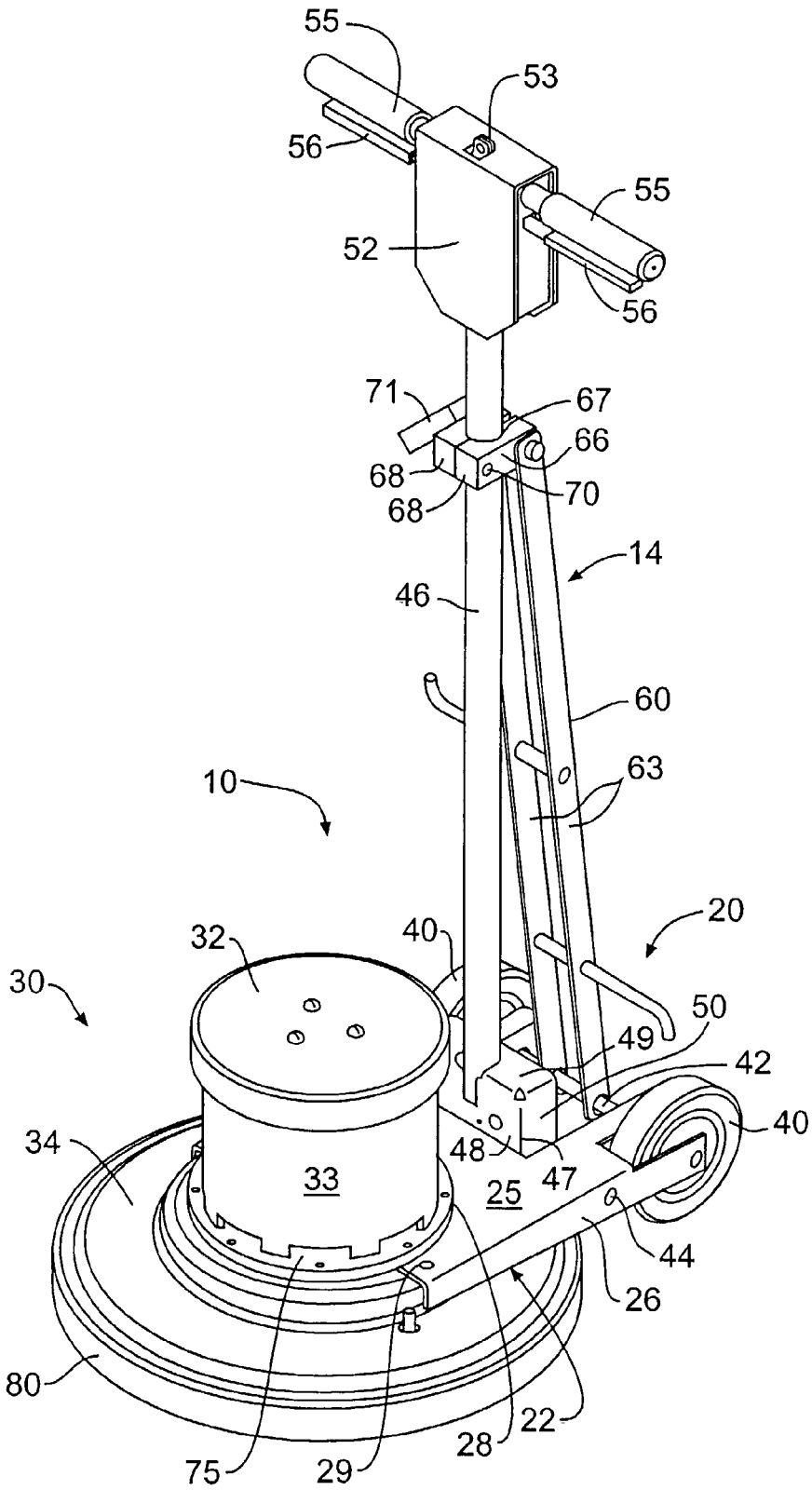
FIG. 1 is a perspective view showing the floor machine of the present invention with the handle/frame assembly engaged to the base/motor and skirt assembly.

Referring to the drawings, there is shown a floor machine generally designed by the numeral 10 comprising a handle/frame assembly 20 and a base assembly 30 comprising a motor 32 and a skirt 34.

The handle/frame assembly 20 includes a frame 22 extending from a leading engagement end 23 to a trailing end 24. The frame 22 has an upper panel 25 and down turned flanges 26 extending downwardly from each of the opposing sides of the panel 25.

Figure 5B:
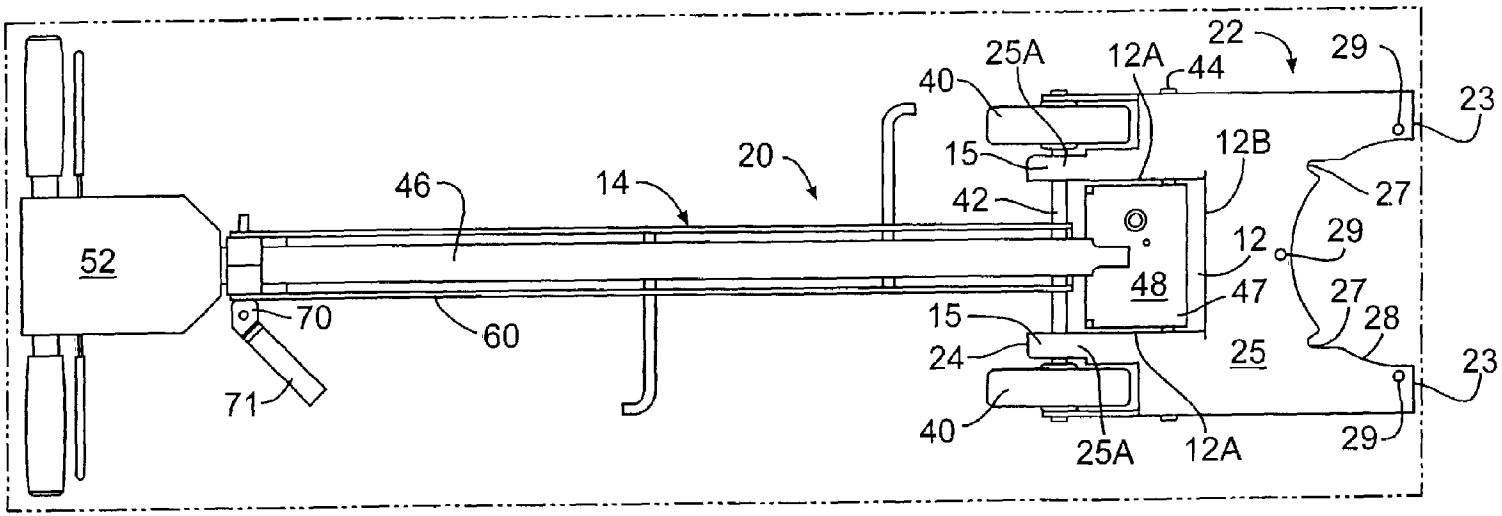
FIG. 5B is a top plan view of the handle/frame assembly with the handle folded for shipping to a position substantially parallel to the frame and showing in dashed lines the size of shipping carton required as viewed from the top.

The leading end 23 of the panel 25 is contoured with a curved section 28 extending along a semi-circular path defining a size to receive a cylindrical side wall portion 33 of the motor 32. The panel 25 is provided with three apertures 29 for receiving bolts 88 (see FIG. 3) or other fasteners for securing the frame 22 to the base assembly 30. The apertures 29 are spaced a short distance from the edge of the curved section 28 and are positioned with the center one of such apertures 29 being centrally positioned in the curved section 28 substantially midway between the opposing flanges 26. The other two apertures 29 are nearly 90° on opposite sides of the central aperture 29 and are closely adjacent to the leading end 23 on opposite sides of the curved section 28. Approximately midway between the center aperature 29 and each of the left and right apertures 29 are notches 27 formed in the leading end 23. As viewed in FIGS. 2 and 5B, the portion of the frame 22 between each of the notches 27 and the leading end 23 may be referred to as spaced-apart arms.

The trailing end 24 of the frame 22 is provided with a cut-out 12 defined by a pair of longitudinally extending edges 12A and a transverse edge 12B. The longitudinal edges 12A define the inner edges of a pair of legs 15 which extend to the trailing end 24. Extending downwardly from the upper panel portion 25A of each of the legs 15 is a downwardly extending flange 16 (See FIGS. 2 and 5B). The legs 15 and their flanges 16 cooperate, respectively, with those portions of the flanges 26 adjacent the trailing end 24 to define spaces for receiving wheels 40. The wheels 40 are supported on an axle 42 which extends between the opposing flanges 26 and also extends through the flanges 16.

Also extending between the opposing flanges 26 and passing through the flanges 16 is a pivot bar 44.

Figure 2:
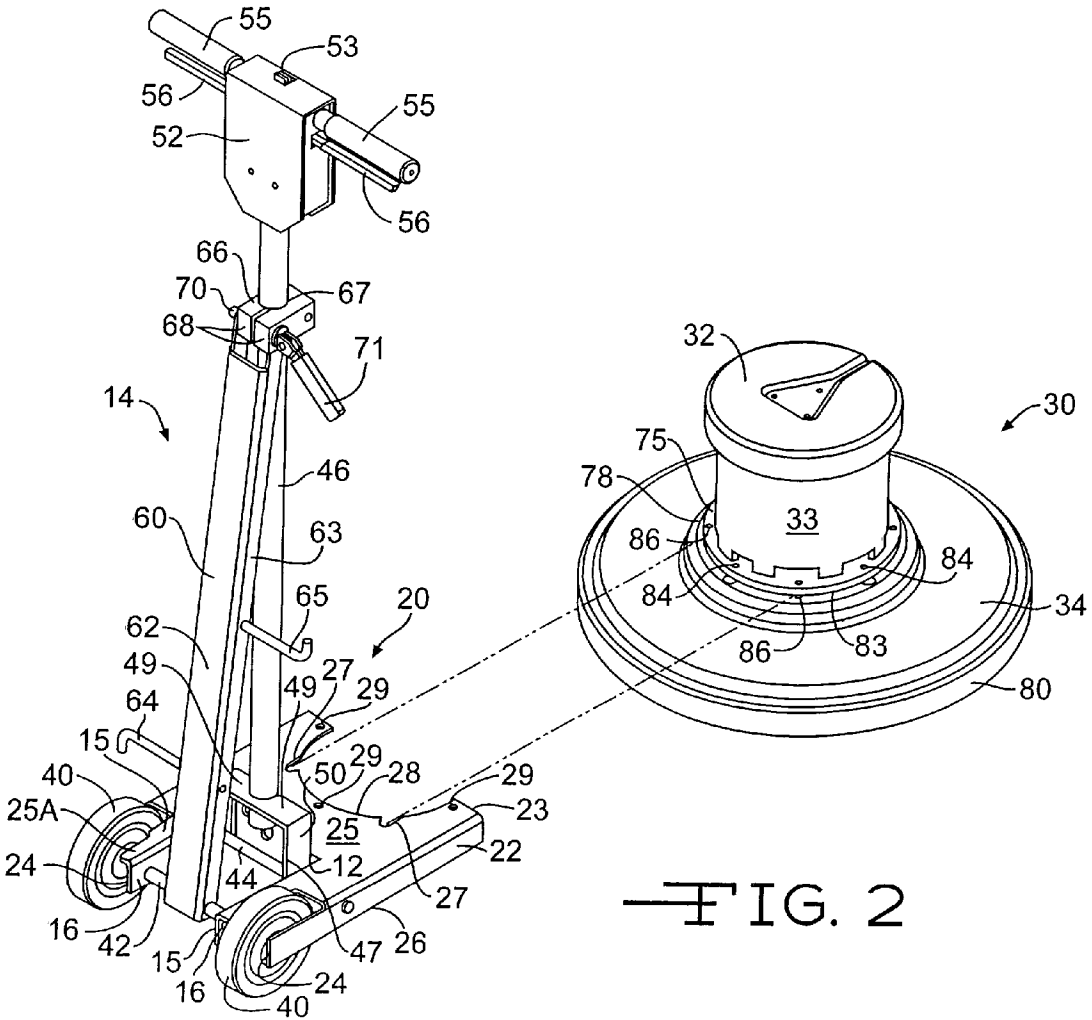
FIG. 2 is an exploded perspective view of the floor machine of the present invention showing the handle/frame assembly separated from the base/motor and skirt assembly.

The handle assembly 14 includes a tubular post 46 secured at its lower end to a housing 47 having a front panel 48 parallel to and slightly spaced from the transverse edge 12B of the trailing cut-out 12 when the handle assembly 14 is in the upright position shown in FIGS. 1 and 2. Extending from the front panel 48 rearwardly when the handle assembly 14 is in the upright position shown in FIGS. 1 and 2, is an upper flange 49 and a pair of spaced-apart downwardly extending flanges 50. The pivot bar 44, extending through both of the flanges 26 and both of the flanges 16, also extends through the spaced-apart downwardly extending flanges 50 of the housing 47. The housing 47 is free to rotate about the pivot bar 44 thereby permitting the post 46 connected thereto to rotate about the pivot bar 44.

The upper end of the post 46 supports a control housing 52 with electrical controls and switch 53, a pair of gripping handles 55 and actuation members 56 extending from the control housing 52 parallel to the handle 55 in spaced relationship therewith. The control housing 52 and the components contained therein and extending therefrom form no part of the present invention.

The other major component of the handle assembly is a slide bar 60 having a panel 62 and a pair of flanges 63 extending from opposite edges thereof. The flanges 63 are each provided with a lower aperture sized to receive the axle 42. The slide bar 60 is free to pivot about the axle 42.

Figure 5A:
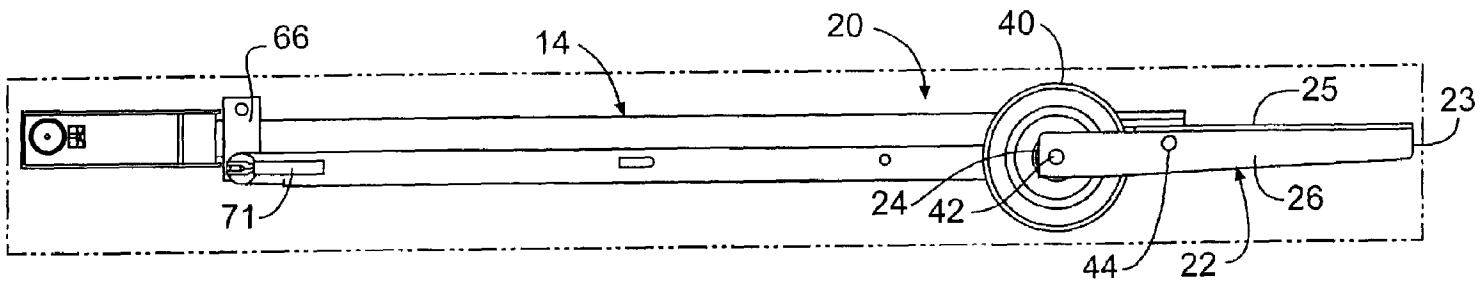
FIG. 5A is an elevational view of the handle/frame assembly showing the handle folded for shipping to a position substantially parallel to the frame and showing in dashed lines the size of shipping carton required as viewed in elevation.

The upper end of the slide bar has connected thereto a gripping member 66 having a central aperature 67 for receiving the post 46. The gripping member 66 is provided with a pair of spaced-apart legs 68. On one side of the aperture, a threaded member 70 having a handle 71 passes through one of the legs 68 and is threadedly engaged to the opposing leg 68. The size of the aperture 67 is such that when the threaded member 70 is loosened so that the legs 68 are separated to their maximum spaced apart position, the post 46 can readily slide therein but that when the threaded member 70 is tightened it will draw the legs 68 closer together reducing the size the aperture 67 and clamping the gripping member 66 to the post 46. When it is desired to move the handle assembly 14 from the raised position shown in FIGS. 1 and 2 to a position in which the handle assembly 14 is parallel to the panel 25 of the frame, it is simply necessary to loosen the threaded member 70 and pivot the post 46 about the pivot bar 44. In making such motion, the slide bar 60 will pivot about the axle 42 and will slide on the post 46 toward the control housing 52 as may be seen in FIGS. 5A and 5B.

If desired, the slide bar 60 may have a hook 64 extending from one side for hanging or wrapping an electric cord used to power the motor 32 and a hook 65 for hanging a pad driver or other articles during maintenance.

The motor 32 of the base assembly 30 has a cylindrical side wall 33 to which is rigidly secured an annular support member 75.

The skirt 34 of the base assembly 30 has a central opening 76 (See FIG. 3) which receives the lower portion of the motor 32. The skirt 34 has a raised area 78 (See FIGS. 4A and 6) adjacent the opening 76. Outwardly from the raised area, the skirt 34 extends downwardly and then tapers outwardly toward an outer periphery defined by a downwardly extending flange 80.

The annular support member 75 secured to the cylindrical sidewall 33 is maintained in spaced apart relationship with the raised area 78 of the skirt 34 by a distance which will permit the curved section 28 at the leading end of the frame 22 to be received in the gap 83 between the top of the raised area 78 and the bottom of the support member 75.

The support member 75 has apertures 84 which are spaced apart and positioned to be aligned with the apertures 29 when the frame 22 is properly positioned in the gap 83. The raised area 78 of the skirt is also provided with apertures 85 (See FIG. 3) which are aligned with the apertures 84 in the support member 75.

Figure 3:
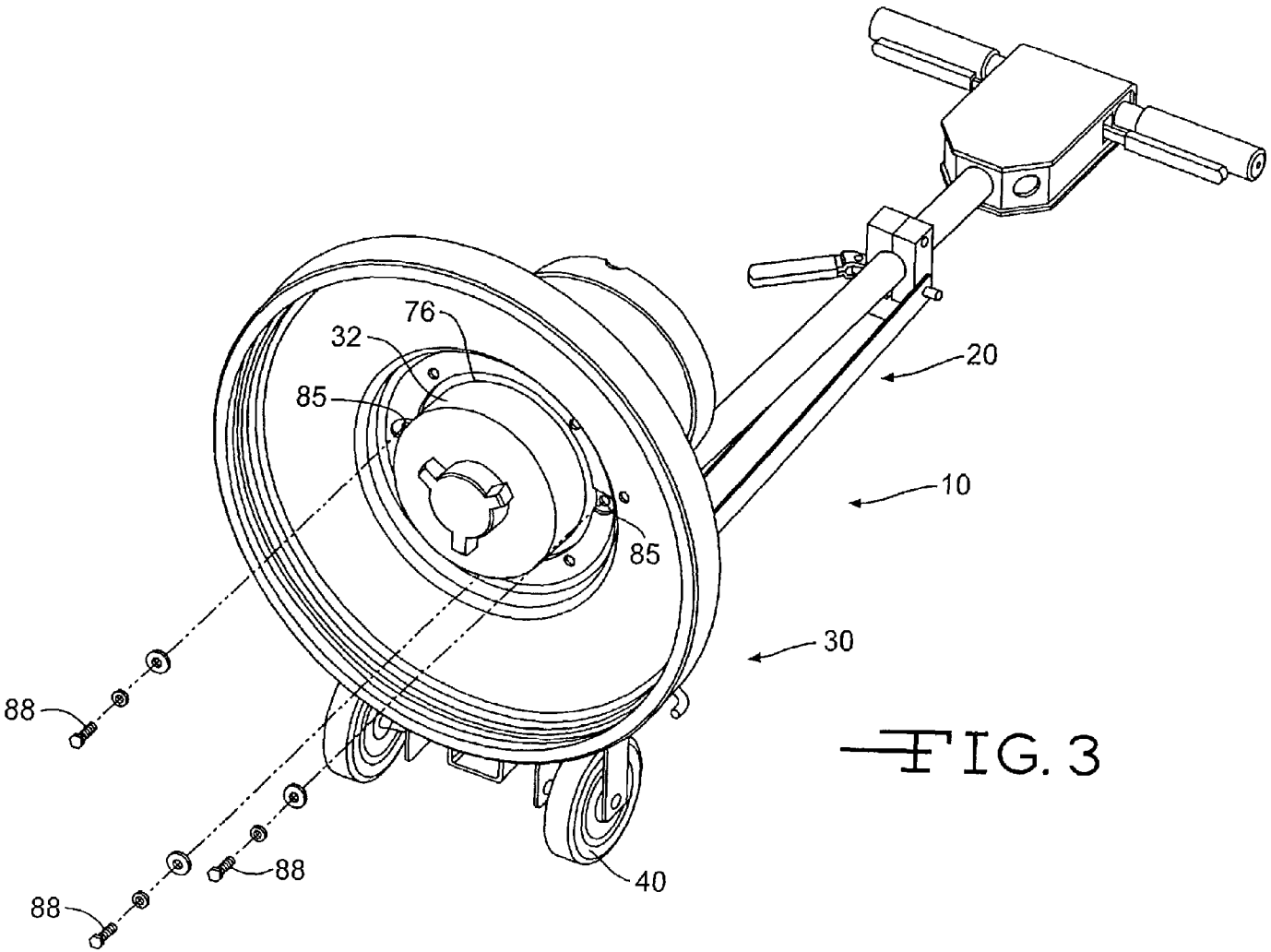
FIG. 3 is an exploded perspective view of the floor machine showing the undersurface of the base/motor and skirt assembly and the means for securing the handle/frame assembly to the base/motor and skirt assembly.
Figure 4B:
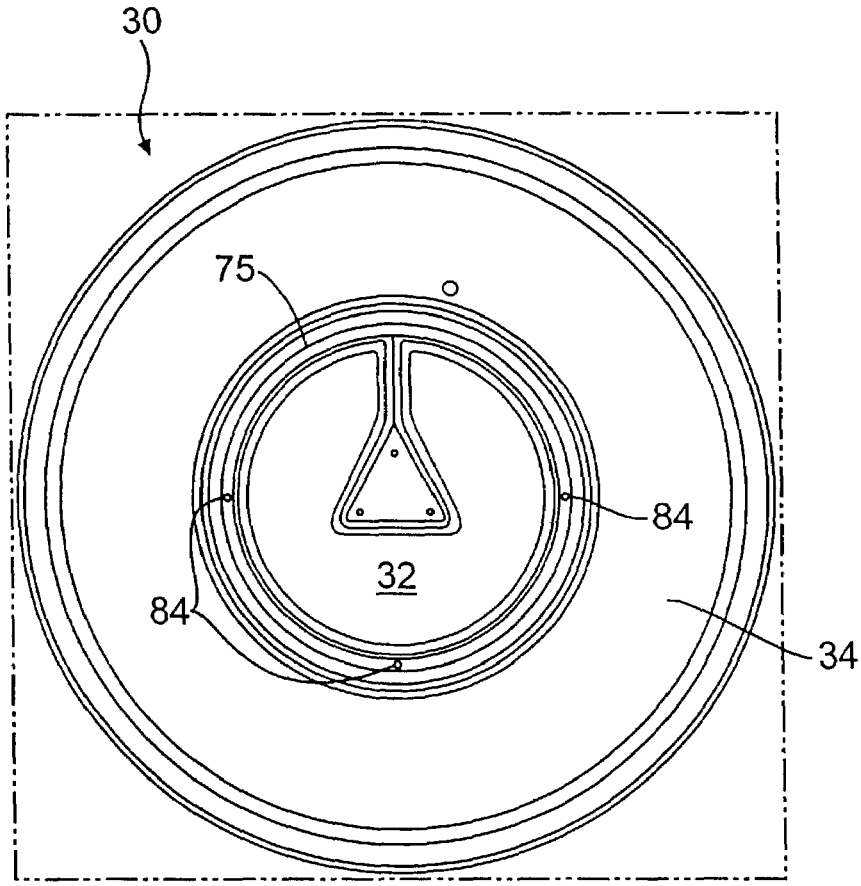
FIG. 4B is a top plan view of the base/motor and skirt assembly and showing in dashed lines the size of shipping carton required as viewed from the top.
Figure 4A:
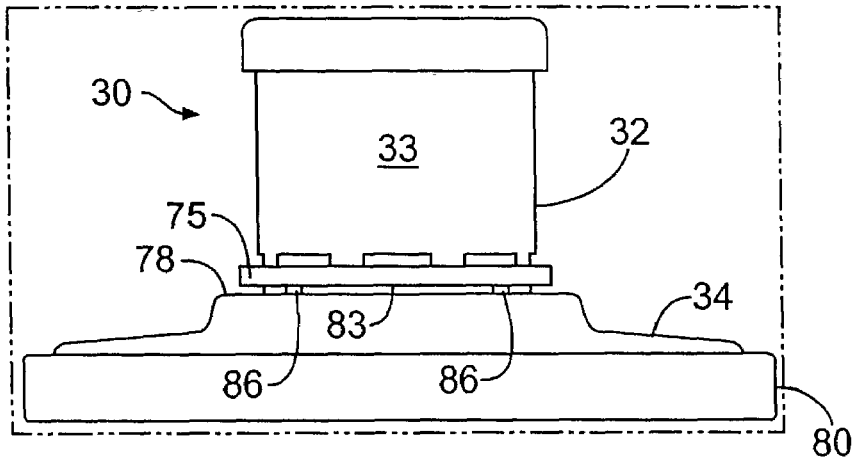
FIG. 4A is an elevational view of the base/motor and skirt assembly and showing in dashed lines the size of shipping carton required as viewed in elevation.

The support member 75 is also provided with two spaced apart pins 86 (See FIG. 2) which extend into the gap 83 and are so positioned as to enter the respective notches 27 at the leading end of the curved section 28 of the frame as the frame 22 is engaged to the base assembly 30 having the motor 32 and skirt 34. Such engagement of the pins 86 in the respective notches 27 serves to easily align the frame 22 so that its apertures 29 become readily aligned with the apertures 84 of the support member 75 and the apertures 85 in the raised area 78 of the skirt 34. Bolts or other fastening devices 88 may then be inserted through the respective aligned apertures 85, 29 and 84 in order to secure the frame 22 and remaining components of the handle/frame assembly 20 to the base assembly 30. Preferably the apertures 84 are threaded to receive the threaded end of bolts 88 inserted from the underside of the skirt as shown in FIG. 3. Other fastening means could be used including bolts which extend completely through the support member apertures 84 with nuts thereafter engaged thereto.

Figure 6:
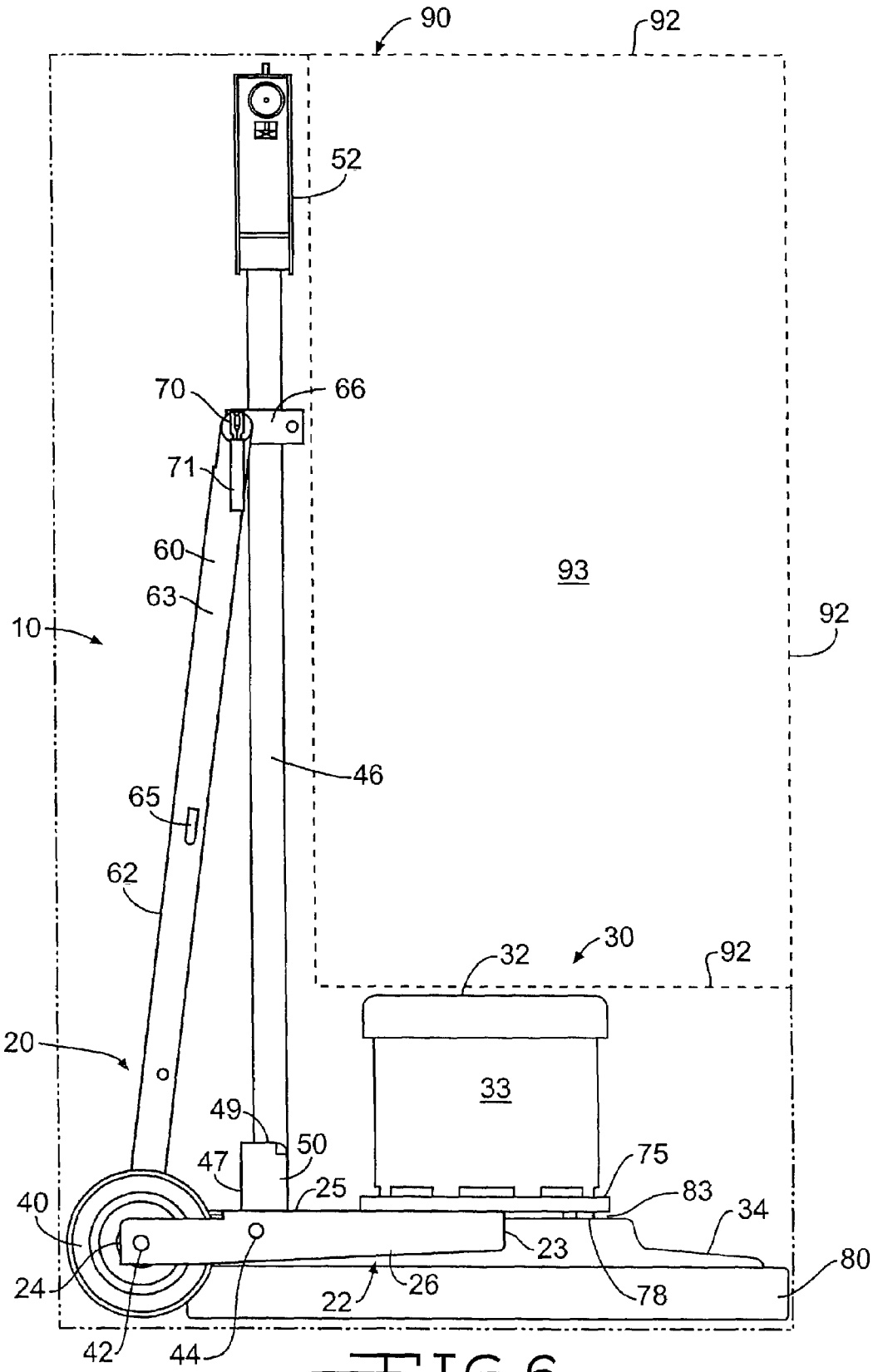
FIG. 6 is a schematic view showing the size carton and wasted space in such carton resulting from shipping a floor machine with an attached handle extending substantially perpendicular to the floor.

FIG. 6 shows in uniform dashed lines 92 the waste space 93 which would be required if the floor machine 10 were shipped in a carton 90 with the handle/frame assembly 20 in an upright position and assembled to the base assembly 30.

The floor machine of the present invention is economical to manufacture. The separate major components of the handle/frame assembly 20 and the base assembly 30 may be shipped in separate shipping containers as shown in FIGS. 4A, 4B and 5A, 5B and yet can be easily assembled with only three bolts required for such assembly.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A floor machine comprising (a) a motor and base assembly including (i) a motor having a sidewall;

(ii) a skirt engaged to and extending outwardly from said motor, said skirt having a top;

(iii) a support member engaged to and extending outwardly from said motor sidewall and having a bottom in spaced relationship to said top of said skirt and cooperating therewith to define a gap; and (iv) alignment members in said gap;

(b) a handle and frame assembly including (i) a frame extending from a leading end engageable with said motor to a trailing end, said leading end having a curved section defining a contour closely approximating that of said motor sidewall and positioned within said gap; and (ii) a handle secured solely to said frame and maintained in spaced relationship to said motor and base assembly; and (c) fasteners engaging said handle and frame assembly to said motor and base assembly, said frame leading end being provided with one or more notches in said curved section engageable with said alignment members.

2. The machine of claim 1 wherein support member has a plurality of spaced apart fastener receiving recesses and said frame has a plurality of spaced apart fastener receiving apertures positioned to be aligned with said support member recesses and said fasteners extend into the respective aligned support member recesses and frame apertures.

3. The machine of claim 2 wherein said frame leading end is provided with first alignment means and said base assembly is provided with second alignment means engageable with said first alignment means and, when so engaged, results in alignment of said frame apertures with said recesses of said support member.

4. The machine of claim 1 wherein said handle and frame assembly includes (a) a post extending from a first end supported on said frame for rotation relative thereto about a first axis to a second end;

(b) a slidebar extending from a first end supported on said frame for rotation relative thereto about a second axis spaced from said first axis to a second end; and (c) a connector engaged to said slidebar second end and slideably engaged to said post.

5. A floor machine comprising (a) a motor and base assembly including (i) a motor having a sidewall;

(ii) a skirt engaged to and extending outwardly from said motor, said skirt having a top;

(iii) a support member engaged to and extending outwardly from said motor sidewall and having a bottom in spaced relationship to said top of said skirt and cooperating therewith to define a gap, said support member having a plurality of spaced apart fastener receiving recesses; and (b) a handle and frame assembly including (i) a frame extending from a leading end engageable with said motor to a trailing end, said leading end having a curved section defining a contour closely approximating that of said motor sidewall and positioned within said gap, said frame having a plurality of spaced apart fastener receiving apertures positioned to be aligned with said support member recesses, and (ii) a handle secured solely to said frame and maintained in spaced relationship to said motor and base assembly; and (c) fasteners engaging said handle and frame assembly to said motor and base assembly, said fasteners extending into the respective aligned support member recesses and frame apertures, said frame leading end being provided with one or more notches in said curved section and further including one or more alignment members in said gap, the positioning of said frame leading end in said gap with said alignment members in said notches resulting in alignment of said frame apertures with said recesses of said support member.

* * * * *